United States Patent [19]

Williamson

[11] 4,041,584

[45] Aug. 16, 1977

[54] LOADING APPARATUS FOR CRIMPER ROLLS

[75] Inventor: Thomas Donald Williamson, Lugoff, S.C.

[73] Assignee: E. I. Du Pont de Nemours and Company, Wilmington, Del.

[21] Appl. No.: 727,660

[22] Filed: Sept. 29, 1976

[51] Int. Cl.[2] ..... D02G 1/12

[52] U.S. Cl. ..... 28/269

[58] Field of Search ..... 28/1.6, 1.7, 72.14, 28/269

[56] References Cited

U.S. PATENT DOCUMENTS

| | | | |
|---|---|---|---|
| 3,162,924 | 12/1964 | Richeson | 28/1.6 |
| 3,225,415 | 12/1965 | Stoveken et al. | 28/1.6 |
| 3,298,079 | 1/1967 | Agett et al. | 28/1.6 |
| 3,639,955 | 2/1972 | Fleissner et al. | 28/1.6 |

*Primary Examiner*—Louis K. Rimrodt

[57] ABSTRACT

A tow crimping apparatus that includes a pair of advancing rolls associated with a crimping chamber is provided with a movable roll to permit controlled loading of the nip between the rolls. The controlled loading is accomplished through a pressure chamber linked to the movable roll and having a restricter in the pressure supply line to the pressure chamber.

5 Claims, 1 Drawing Figure

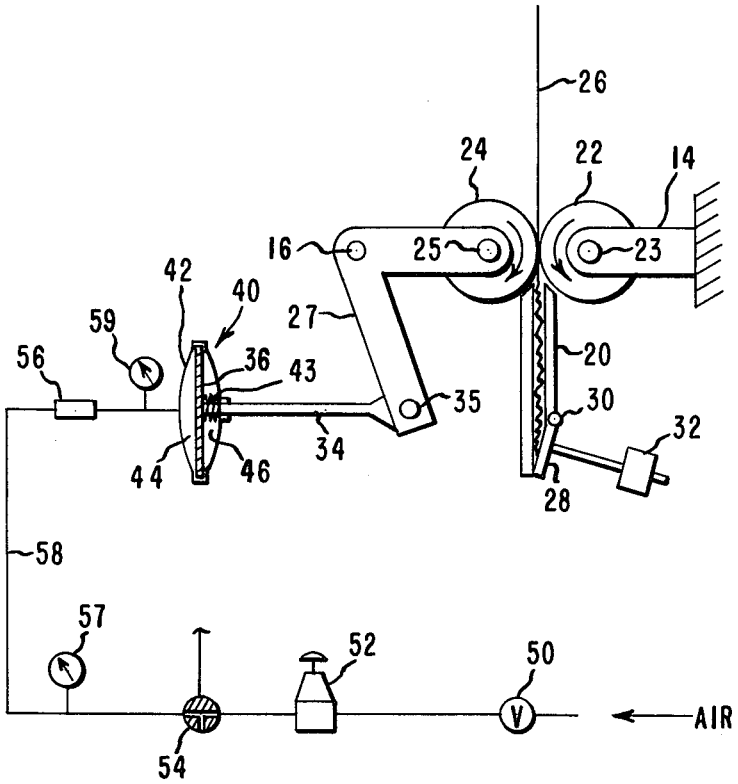
26
24
22
14
16
25
23
42
40
27
59
56
36
43
20
35
30
32
34
44
46
28
58
57
52
50
54
AIR

LOADING APPARATUS FOR CRIMPER ROLLS

BACKGROUND OF THE INVENTION

This invention relates to an apparatus for crimping filamentary tow and more particularly to a loading arrangement for one of the forwarding rolls used to feed the tow into a stuffing box crimper.

It is well known in the art to crimp synthetic filaments that are to be processed either as broken tow or cut staple on textile processing equipment to yield yarns useful in the manufacture of fabrics. Without crimp, the tow or staple has low cohesiveness and cannot be drafted to uniform yarns on commercial textile equipment. One form of apparatus for crimping of filaments is the stuffing box crimper described in U.S. Pat. No. 2,747,233.

The crimping process usually is operated under conditions so critical that minor variations in the process can lead to crimper upsets which can result in severe product property variations such as unsatisfactory fiber properties and inadequate crimp.

A process variable that tends to give crimper upsets is the short term variations in crimper feed-rope denier resulting from merging of new ends with run-out tails of the old. Even if merges are staggered so that no two occur in parallel, the short-length increase in overall rope size can be sufficient, especially in high-speed processes, to initiate roll-clearance oscillations and out-of-control crimping during processing of several yards of rope. This problem was recognized by Stoveken and Talbott in their U.S. Pat. NO. 3,225,415, which teaches a sophisticated means to restore equilibrium operation following an upset.

SUMMARY OF THE INVENTION

In an apparatus for crimping filamentary tow including a pair of driven rolls cooperating to form a nip between the rolls through which tow passes to a crimper chamber associated with said rolls, one of said rolls being movable with respect to the other to form an adjustable width nip, the improvement comprising: a loading device having a flexible diaphragm dividing a single chamber into a front chamber and a sealed back chamber; a source of pressurized air in communication with the back chamber; a gas flow restricter connected between said source and said back chamber adjacent to said back chamber; and a linkage passing through said front chamber connected between the central portion of said diaphragm and said movable roll.

BRIEF DESCRIPTION OF THE DRAWING

The FIGURE is a schematic side elevation view of a stuffer box crimper coupled to the roll loading system of this invention.

DETAILED DESCRIPTION OF THE PREFERRED EMBODIMENT

The crimper chosen for purposes of illustration includes a stuffing box 20, a pair of crimper rolls 22, 24 associated with and located above the entrance to the stuffing box for feeding a tow of filamentary material 26 into the box. The bottom of the stuffing box 20 is closed by a clapper 28 which pivots about pin 30 and is under a controlled degree of loading schematically shown as weight 32. Roll 22 is rotatably mounted on pin 23 in fixed bracket 14 and driven by means not shown while roll 24 is rotatably mounted on pin 25 in one leg of L-shaped arm 27 which is pivotally mounted for swinging movement about pin 16 at the apex of the arm 27. The other leg of arm 27 is pivotally connected to one end of rod 34 through pin 35. The other end of rod 34 is connected to the central portion of flexible diaphragm 36 of loading device 40. Thus, the rod 34 and the arm 27 and associated pins 16, 25 and 35 form a linkage between diaphragm 36 and roll 24. The loading device 40 (typically a Robotair Chamber Type 3 by Bendix-Westinghouse) comprises a housing 42 divided into a front chamber 46 and a back chamber 44 by diaphragm 36. A return spring 43 is positioned against diaphragm 36 in front chamber 46. The back chamber or pressure chamber 44 is in communication with a source of pressurized air through valve 50, pressure regulator 52, three-way valve 54 and restricter 56 located adjacent to the loading device 40 all serially connected in pipeline 58. Restricter 56 limits the flow of air to or from back chamber 44 and is in the form of a sintered metal plug which can be a Pressure Snubber No. 25S supplied by Chemiquip Products Co., Inc. Gages 57 and 59 are tied into pipeline 50 to indicate (1) pressure supplied to chamber 44 and (2) the pressure between the chamber 44 and the restricter 56, respectively.

In operation, when a short section of larger-denier tow passes between rolls 22 and 24, roll 24 is moved away from roll 22 compressing the air in chamber 44 to a higher pressure than indicated by gage 57 via the linkage of arm 27 and rod 34. Air immediately begins to flow through restricter 56 into supply line 58 but at a slow rate. When the larger-denier section of tow has passed rolls 22, 24, the immediate need is to restore roll 24 to its just-previous equilibrium position. The higher pressure developed in chamber 44 by the displacement of roll 24 tends to restrict displacement of roll 24 and most of it remains as higher-than-normal pressure acting to restore equilibrium.

The combination of a single-acting loading device 40 and a restricter 56 in the actuating air line is more effective in restoring equilibrium operation following an upset than the more complex double-acting prior art devices.

Benefits are seen with more uniform crimping with the improved crimping apparatus of this invention. For example, it has been found that two crimpers, operating side-by-side under the same conditions with the same filamentary product will deliver crimped tows of nearly identical water and textile finish content, which was not attainable with art-known crimpers. This is a substantial advantage since predictable textile processability is dependent on uniformity in both finish and water content. Crimped rope (or staple) of uniform moisture content dries more uniformly in a given process than does rope or staple with variable, or different, moisture content. In one large-scale comparison of processabilities on a Turbo Stapler, a commercial machine for draft-breaking of tow to sliver, the operator found it necessary to stop the machine an average of 1.37 times per 1000 pounds (3.03 times/Mg) while processing about 55,000 pounds (~25,000 kg) of 470,000-denier (52,170 tex) tow that had been processed through a more complex crimper previously known in the art as 340,000-denier (37,740 tex) drawn rope (the higher denier of the tow being due to process relaxation after draw). In two tests, involving about 63,000 pounds (~29,000 kg) and about 89,000 pounds (~40,000 kg) of the same size tow processed through the crimper of this invention, machine stops averaged 0.74/1000 pounds (1.64/Mg) and 0.66/1000 pounds (1.45/Mg), respectively. It is well recognized in the trade that tow quality is the major factor in continuity of this operation. Reduction to about half-normal machine stops means a significant saving in labor, less fiber waste and more uniform-quality yarns.

What is claimed is:

1. In an apparatus for crimping tow including a pair of rolls cooperating to form a nip between the rolls through which tow passes to a crimper chamber associated with said rolls, one of said rolls being movable with respect to the other to form an adjustable width nip, the improvement comprising: a single-acting loading device having a diaphragm dividing a single chamber into front and back chambers; a source of pressurized fluid in communication with the back chamber; a restricter connected between said source and said back chamber; and a linkage passing through said front chamber and connected between said diaphragm and said movable roll.

2. The apparatus as defined in claim 1, said restricter being located adjacent said back chamber.

3. The apparatus as defined in claim 2, said fluid being a gas.

4. The apparatus as defined in claim 3, said gas being air.

5. In an apparatus for crimping filamentary tow including a pair of driven rolls cooperating to form a nip between the rolls through which tow passes to a crimper chamber associated with said rolls, one of said rolls being movable with respect to the other to from an adjustable width nip, the improvement comprising: a single-acting loading device having a flexible diaphragm dividing a single chamber into a front chamber and a sealed back chamber; a source of pressurized air in communication with the back chamber; a gas flow restricter connected between said source and said back chamber adjacent to said back chamber; and a linkage passing through said front chamber connected between the central portion of said diaphragm and said movable roll.

* * * * *